US005511491A

United States Patent [19]

Hesch et al.

[11] Patent Number: 5,511,491

[45] Date of Patent: Apr. 30, 1996

[54] RAILWAY CAR

[75] Inventors: Harold E. Hesch, St. John, Ind.; Albert A. Beers, Duncanville; Stephen W. Smith, Dallas, both of Tex.

[73] Assignee: Trinity Industries, Inc., Dallas, Tex.

[21] Appl. No.: 386,876

[22] Filed: Feb. 10, 1995

Related U.S. Application Data

[63] Continuation of Ser. No. 152,915, Nov. 12, 1993, Pat. No. 5,392,717, which is a continuation of Ser. No. 944,169, Sep. 11, 1992, abandoned.

[51] Int. Cl.[6] ..... B61D 17/00

[52] U.S. Cl. ..... 105/404; 105/4.1; 105/18; 105/458; 105/355

[58] Field of Search ..... 105/18, 4.1, 404, 105/355, 416, 419, 409, 401, 458, 375, 403

[56] References Cited

U.S. PATENT DOCUMENTS

| | | | |
|---|---|---|---|
| 856,435 | 6/1907 | Wagenhals | 105/401 |
| 1,178,909 | 4/1916 | Fisher | 105/18 |
| 1,535,799 | 4/1925 | Adams | 105/18 |
| 1,881,850 | 10/1932 | Morton | 105/18 |
| 2,788,750 | 4/1957 | Priest | 105/406 |
| 3,370,552 | 2/1968 | Podesta et al. | 105/368 |
| 3,678,863 | 7/1972 | Pringle | 105/4 R |
| 4,144,820 | 3/1979 | Jaekle et al. | 105/368 |
| 4,503,779 | 3/1985 | Chadwick | 105/4 R |
| 4,913,061 | 4/1990 | Youngblood | 105/378 |
| 4,958,977 | 9/1990 | Snead | 414/339 |
| 5,246,321 | 9/1993 | Hesch | 410/58 |
| 5,320,046 | 6/1994 | Hesch | 105/413 |
| 5,407,309 | 8/1995 | Hesch et al. | 410/56 |

FOREIGN PATENT DOCUMENTS

| | | | |
|---|---|---|---|
| 2318369 | 10/1974 | Germany | 105/18 |

OTHER PUBLICATIONS

"Trinity Auto Racks" brochure, Trinity Industries, Inc., Freight Car Division.

Greg Borzo, "Trinity Buys Plant to Build Auto Racks", *Modern Railroads,* Mar., 1989, pp. 40–41.

Amy Brown and Fred Kurzeja, "How to Hold Onto Auto Business", *Modern Railroads,* Oct., 1989, pp. 16, 19.

Paul A. Eisenstein, "ROAD Team Gets Good Grip on Crime", Journal of Commerce Special.

*Primary Examiner*—Mark T. Le

*Attorney, Agent, or Firm*—Baker & Botts

[57] ABSTRACT

An improved automobile transport railway car that is constructed from noncorroding materials adjacent to load carrying areas and that is enclosed by doors on both ends of the car. In the case of the articulated cars, a bellows assembly encloses and spans the ends of adjacent units. The car may be provided with two or more decks and has walls and a roof preferably constructed from nested, pultruded sections that are light in weight and are non-corrodible.

19 Claims, 8 Drawing Sheets

180
164
174
172
176
144
166
178
168
142
42
170
39
184
182
186
42
52
142
138
162
160
42

RAILWAY CAR

This application is a continuation of U.S. application Ser. No. 08/152,915 filed Nov. 12, 1993 and entitled Improved Railway Car, now U.S. Pat. No. 5,392,717 dated Feb. 28, 1995, which is a continuation of U.S. application Ser. No. 07/944,169 filed Sep. 11, 1992, now abandoned.

TECHNICAL FIELD OF THE INVENTION

This invention relates generally to an improved railway car. More particularly, but not by way of limitation, it relates to an improved railway car for transporting automobiles and the like.

BACKGROUND OF THE INVENTION

Over the years, railway cars utilized for the transportation of automobiles and the like have progressed from the use of a simple flat car to more elaborate arrangements whereby the cars can be easily loaded and more recently into double and triple decked cars wherein more automobiles can be carried.

Some of the newer auto transport cars, are of the multiple unit articulated type wherein wheeled railway trucks support adjacent ends of the units thereby providing a more efficient car. Loading bridges have been utilized to span between the decks or floors of the cars so that automobiles can be loaded from one end throughout all of the units.

In the recent past, auto transport cars have been closed, that is, paneling has been inserted in the sides to aid in protecting the automobiles from theft and vandalism. With the addition of end doors on the units, the automobiles are also protected against vandalism and theft during their transportation.

Several problems exist particularly with the articulated unit cars since it is not practical to place end doors on each of the units but rather just on the end of the end units forming the car. Thus, there has been a space between the units through which vandals can enter and through which weather can affect the automobiles carried inside. Another problem that exists is that the cars have been constructed from steel for the most part and, due to weather conditions, rusting of the steel even with good paint and good maintenance results in the possibility of rust damage on the vehicles or automobiles being carried by the cars.

In accordance with the foregoing, it is highly desirable to provide a car for transporting automobiles that can be completely enclosed, that is constructed from materials other than steel to avoid the rust problem that reduces maintenance, and that includes some means for enclosing the space between the units of a car to prevent weather from affecting the cars as well as to avoid problems of vandalism.

SUMMARY OF THE INVENTION

Accordingly, this invention provides an improved railway car that includes a car having a floor, sidewalls, a roof, and end doors so that the car is totally enclosed.

In another aspect, this invention provides an improved railway car that includes a plurality of units and comprises on each unit a floor, sidewalls, roof, end doors located on the end units, and a bellows assembly spanning the space between adjacent units.

BRIEF DESCRIPTION OF THE DRAWINGS

The foregoing and additional objects and advantages of the invention will become more apparent as the following detailed description is read in conjunction with the accompanying drawing or in like reference characters denote like parts and all views and wherein.

DETAILED DESCRIPTION OF THE INVENTION

Figure 1:
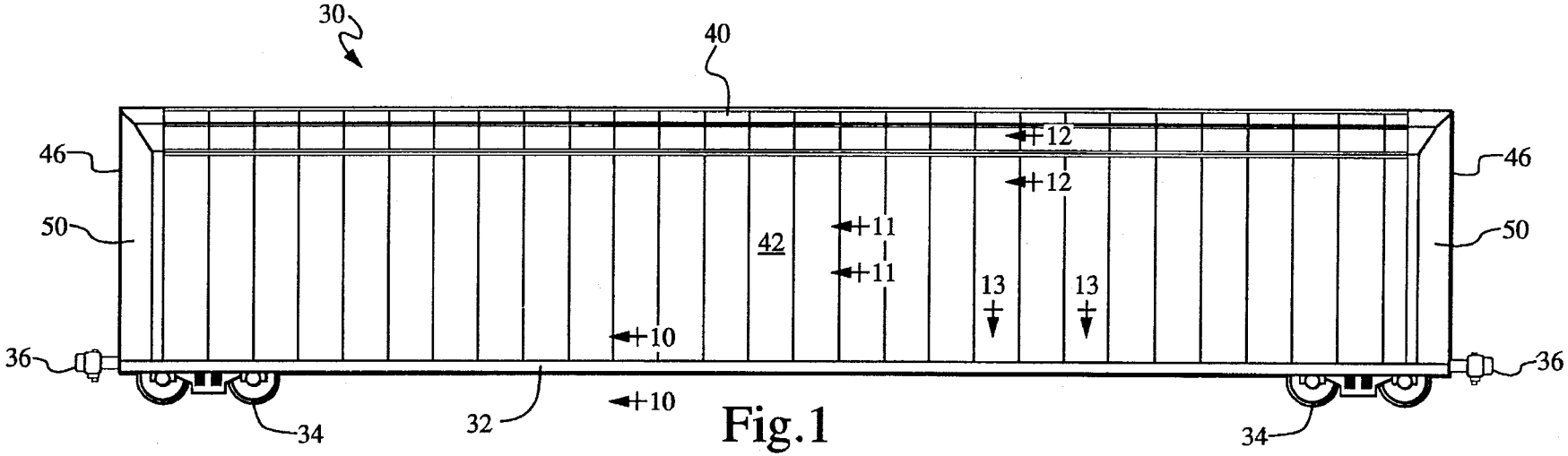
FIG. 1 is a side elevation view of an automobile transport car that is constructed in accordance with the invention.
Figure 2:
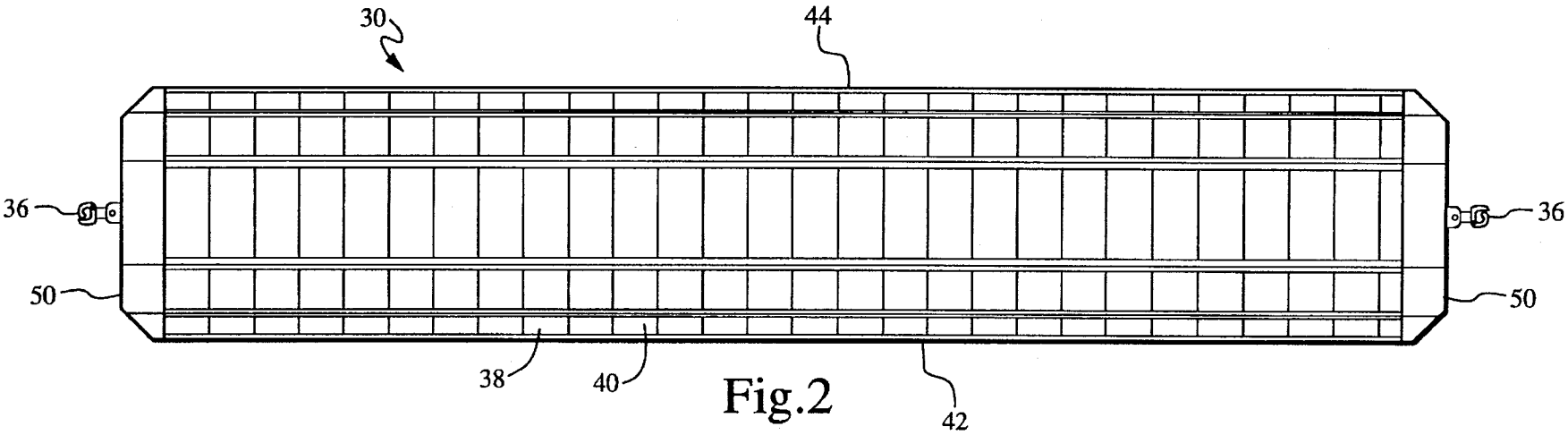
FIG. 2 is a top view of the car of FIG. 1.

Referring to FIGS. 1 and 2 in particular, shown therein and generally designated by the reference character 30 is a railway automobile transport car that is constructed in accordance with the invention. The car 30 includes a frame assembly 32 that is supported at each end by trucks 34. Each end of the frame assembly 32 is also provided with a coupler 36 for connecting the car 30 into a train.

As illustrated, the car 30 includes a hollow, box-like structure 38 that has a roof 40, sidewalls 42 and 44 and ends 46 and 48. As illustrated, the ends 46 and 48 each include a pair of doors 50 that are arranged to prevent access to the interior of the car 30 when closed and to allow access to the interior of the car when opened.

Figure 13:
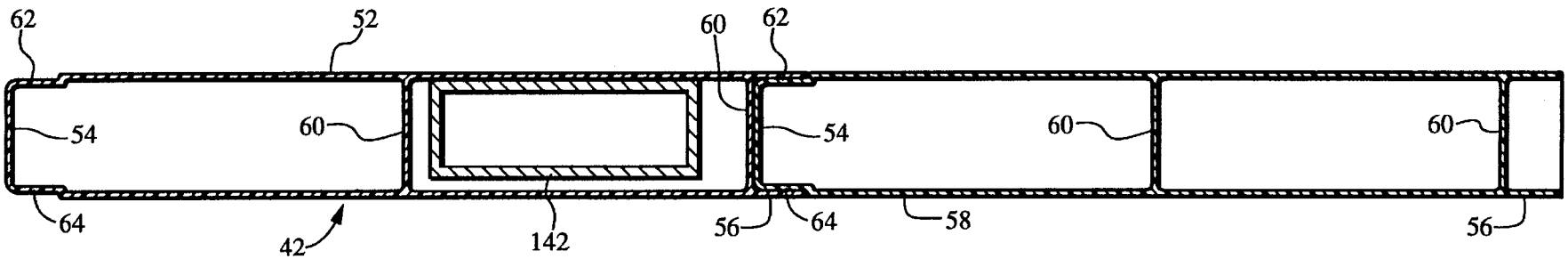
FIG. 13 is an enlarged, fragmentary cross-sectional view taken along the line 13—13 of FIG. 1.

The walls 42 and 44 and the roof 40 are preferably constructed from composite material such as FIBERGLAS as shown in FIG. 13 that are formed by a process known as "pultrusion". Each section is elongated and has a cross-section as illustrated in FIG. 13. A section of the wall 42 is shown in FIG. 13 and includes a first pultruded section 52 that has an end 54 formed to nest into an end 56 of an adjacent pultruded section 58. The sections are all identical in configuration and include a spacer 60 that extends thereacross to hold the inner and outer walls 52 and 58 in spaced relationship. The sections are preferably glued together at 62 and 64 to form very rigid sidewalls. Similarly, the roof 40 is formed of identical pultruded sections that are also glued together.

Figure 6:
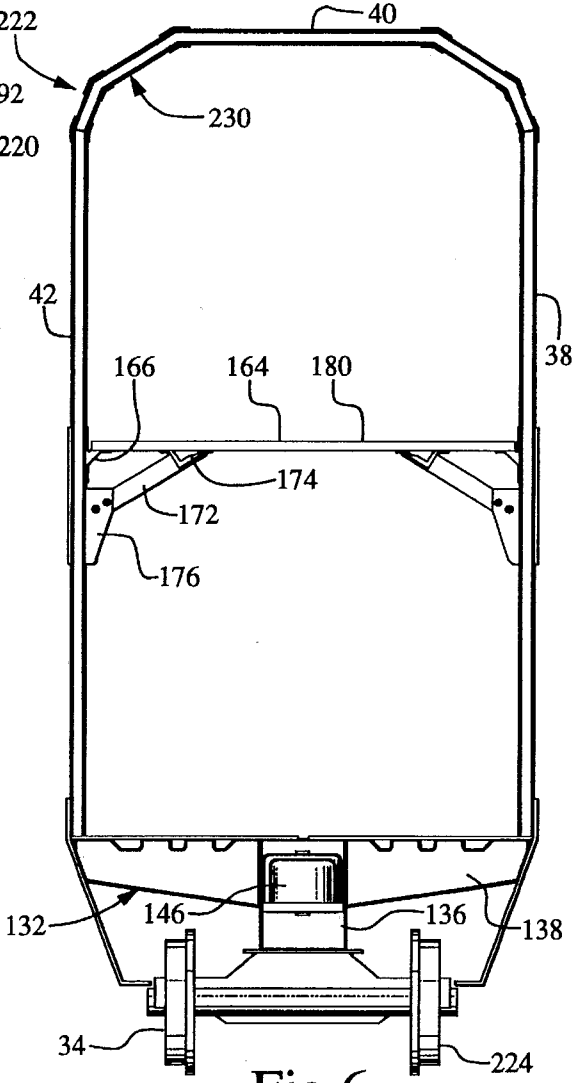
FIG. 6 is an end view of an intermediate unit.
Figure 9:
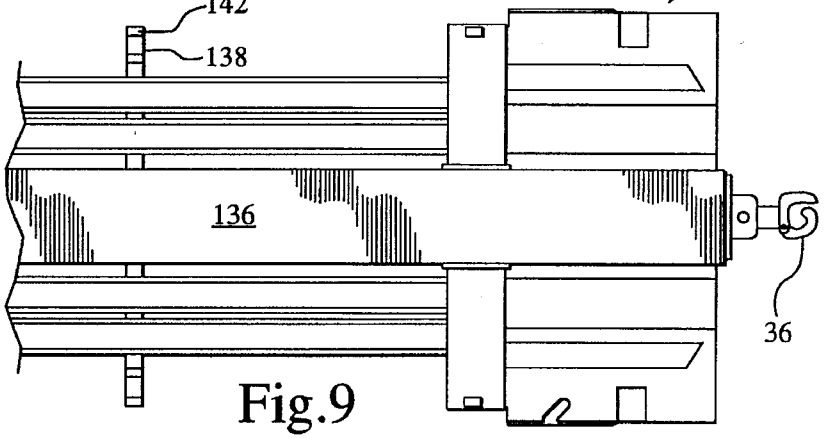
FIG. 9 is a fragmentary plan view of a portion of a frame of end unit.

While the exact frame for the car 30 is not illustrated, FIG. 6 shows a frame 132 for an intermediate unit which will be described later. The frame 132 is essentially the same as the frame for the car 30. The main differences lie in the end structures which are as illustrated in FIG. 9 and designated by the reference character 134. That is, both ends of the frame structure 132 include an end structure 134 to support end doors 133 (see FIG. 5).

Figure 7:
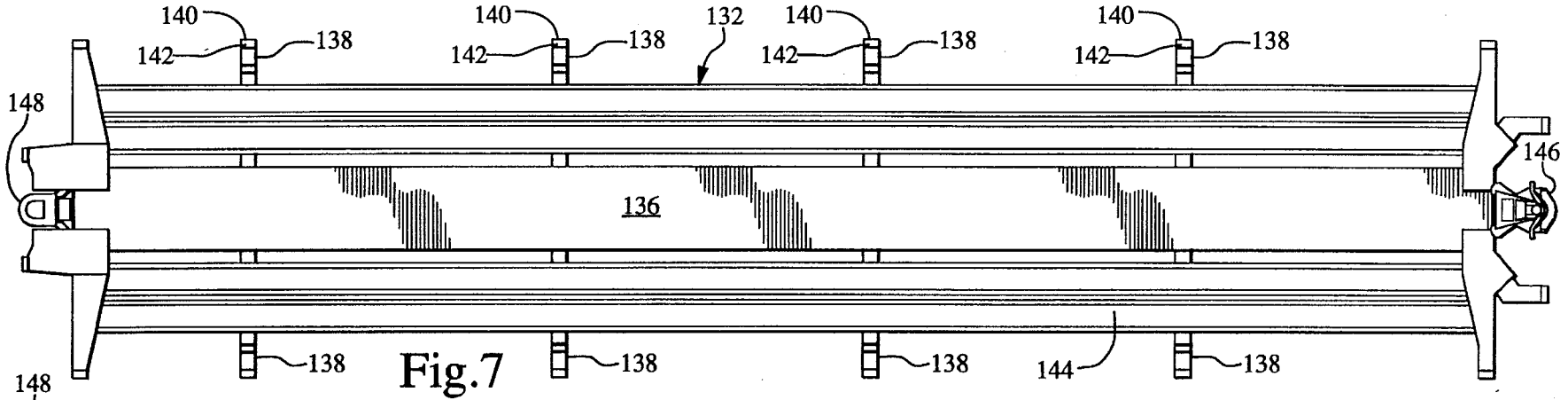
FIG. 7 is a plan view of an under frame for the intermediate unit.
Figure 8:
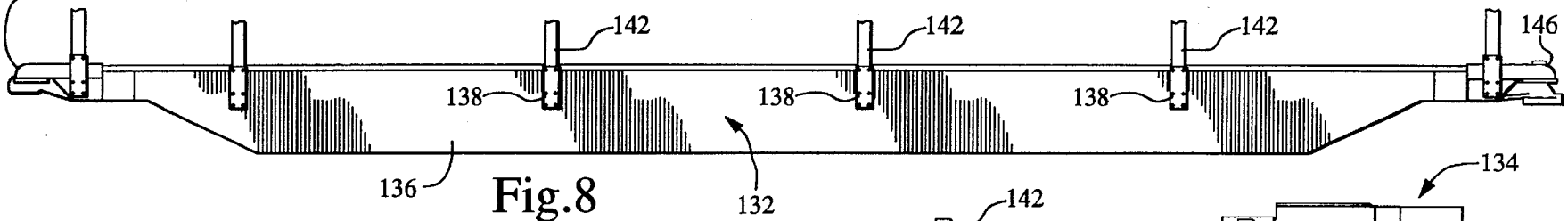
FIG. 8 is a side view of the frame of FIG. 7.

In FIG. 6, it can be seen that the frame 132 includes a central beam or center sill 136 that extends from one end of each unit to the other and that is provided with a plurality of cross bearers 138 that are arranged essentially perpendicular to the length of the center sill 136. Each crossbearer 138 has free ends 140 thereon. As can be seen most clearly in FIG. 7, vertically extending wall support posts 142 are mounted on each end of the cross bearers 138. Although some of the cross bearers have a slightly different configuration, they each serve to support a lower floor or deck 144 and to support the wall support posts 142.

At one end of the center sill 136 there is mounted a coupler half 146 and at the opposite end of the center sill 136 is mounted a coupler half 148. The coupler halves are of a type which permit the intermediate units to be connected to end units as will be subsequently described.

Figures 10, 11, 12:
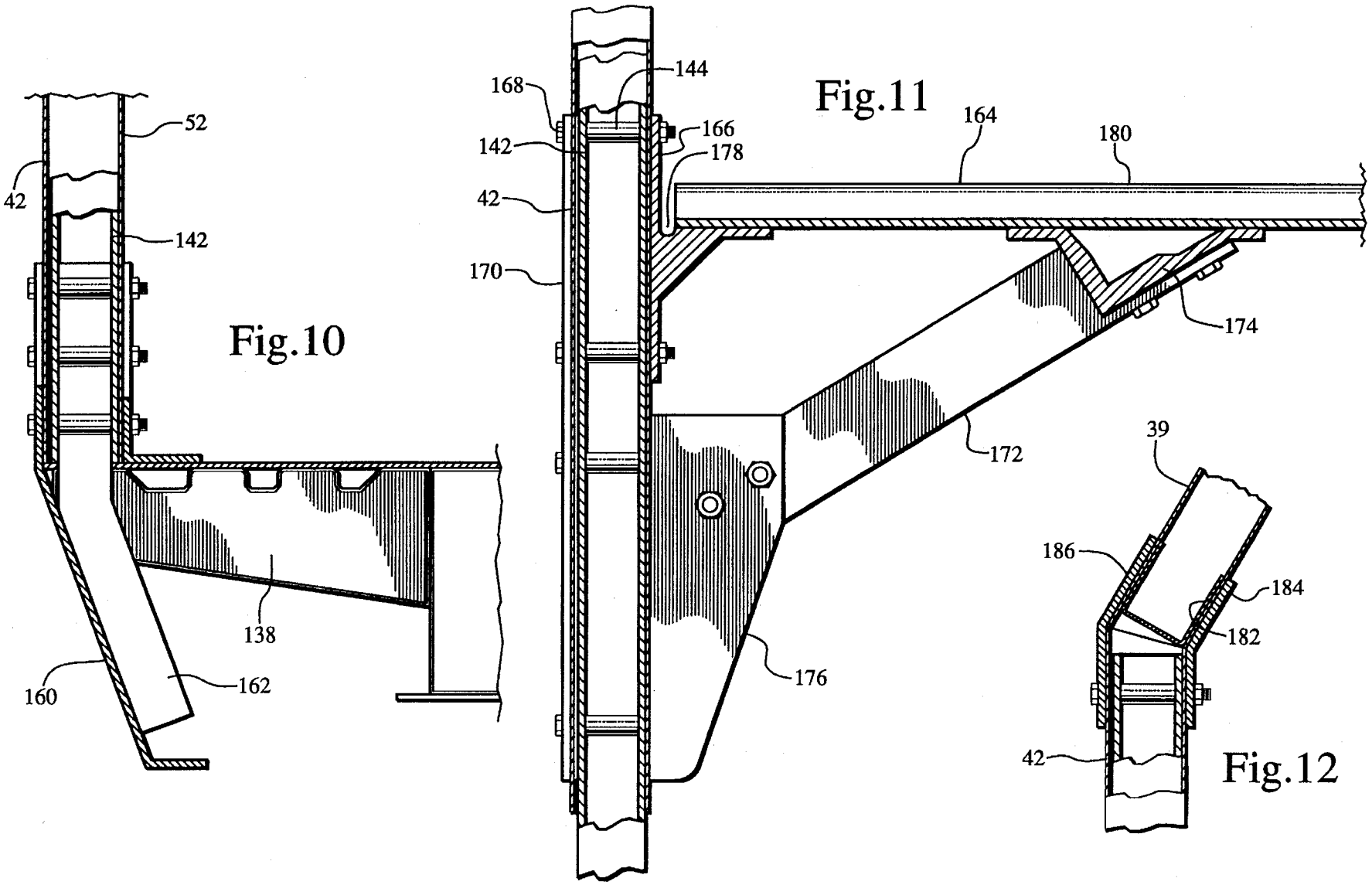
FIG. 10 is an enlarged, fragmentary cross-sectional view taken along the line 10—10 of FIG. 1.
FIG. 11 is an enlarged, fragmentary cross-sectional view taken along the line 11—11 of FIG. 1.
FIG. 12 is an enlarged, fragmentary cross-sectional view taken along the line 12—12 of FIG. 1.

In FIG. 10, which is a cross-section taken through the wall 42 to illustrate the relative positions between the panels 52 and the vertical wall support posts 142. As shown in FIG. 10, the post 142 is located on the end of one of the cross bearers 138. Extending down below the cross bearer 138 is a sidesill 160 which is supported by a sidesill mounting member 162 that is also connected to the cross bearer 138. Although the only one member 162 is illustrated, it will be understood that they are spaced along the frame 132 to support sidesills 160 on each side of the units or cars.

FIG. 11 is an enlarged, cross-sectional view taken generally along the line 11—11 of FIG. 1 illustrating the attachment and support of an upper deck or floor 164 on the sidewalls 42. As shown therein, an extruded support member 166 extends the entire length of the units or car and is connected to the sidewall support posts 142 by plurality of fasteners which extend through spacers 144 disposed within the post 142. To support the pultruded wall portion, a spacer 168 is located between the wall and the exterior of the post 142. A reinforcement plate 170 is positioned on the exterior of the wall at each of the locations adjacent to braces 172 which extend from the sidewall 42 to the underneath of the upper floor 164.

To assist the brace 172 to remain in position, a car length extrusion 174 is attached to the lower side of the floor 164 for connection to the brace 172. It should also be noted that gussets 176 are connected to the sidewall 42 in a manner similar to connection of the extrusion 166 thereto.

Referring to the extrusion 166, it will be noted that a recess or groove 178 is located adjacent to the sidewall 42. A second groove is located adjacent to the sidewall 44. The floor 164 preferably formed with corrugations 180 that extend cross-wise of the car so that any moisture entering the car 30 will drain to the left and right sides of the car, through the grooves 178 and out of the unit or car without affecting the automobiles that may be located in the car below on the lower deck.

FIG. 12 is a cross sectional view taken generally along the line 12—12 of FIG. 1 illustrating the attachment of the roof 40 to the sidewall 42. To support the edges of the pultruded sections forming the roof 40, channels 182 have been glued into the edges of the roof 40. Angle members 184 and 186 extend the full length of the roof and are glued thereto. They extend downwardly over the walls 42 and 44 and are bolted to the walls as illustrated in FIG. 12.

Figure 14:
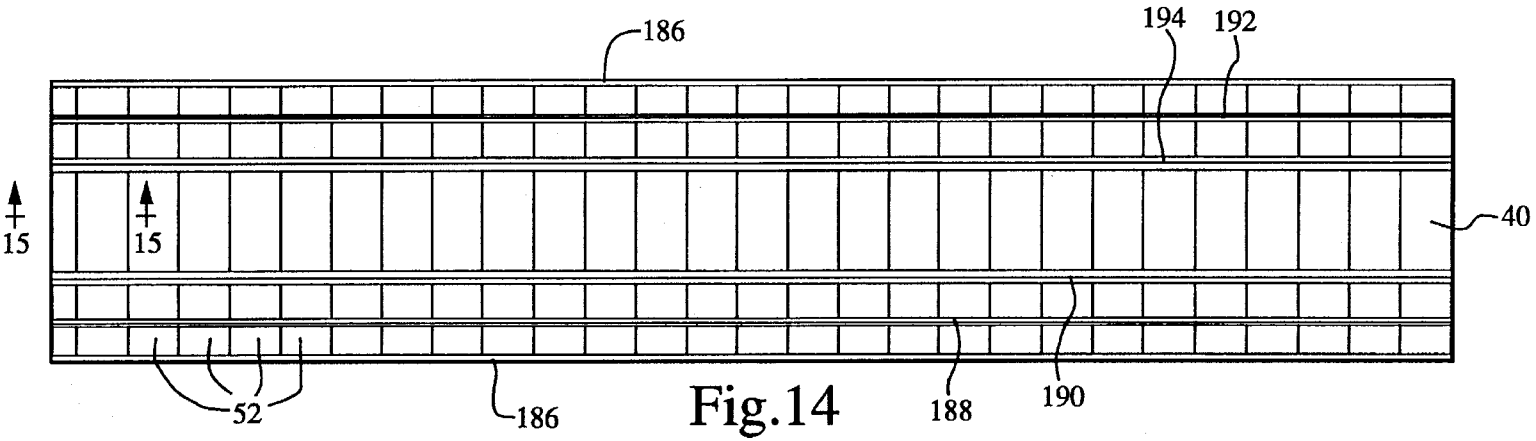
FIG. 14 is an enlarged plan view of the roof of an intermediate unit.

The roof 40 can be seen more clearly in FIG. 14 with the pultruded sections extending generally perpendicular to the longitudinal center line of the roof. In addition, mitered joints, such as at 188 and 190, are held together by angle members 192 and 194 which also extend the full length of the roof and are glued to the roof as previously described.

Figure 15:
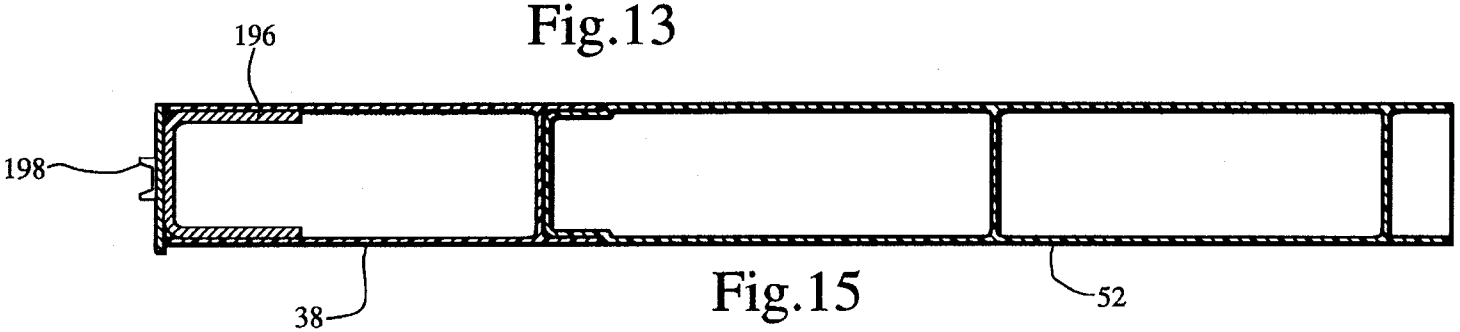
FIG. 15 is an enlarged fragmentary cross-sectional view taken along the line 15—15 of FIG. 14.

As best shown in FIG. 15, the front and rear edges of the roof 40 are provided with a channel 196 which has been glued therein to support the free edges of the pultruded sections forming the roof. As may also be seen in FIG. 15, a bracket 198 is arranged to receive an edge of the bellows assembly which will be described in more detail hereinafter.

Figure 3:
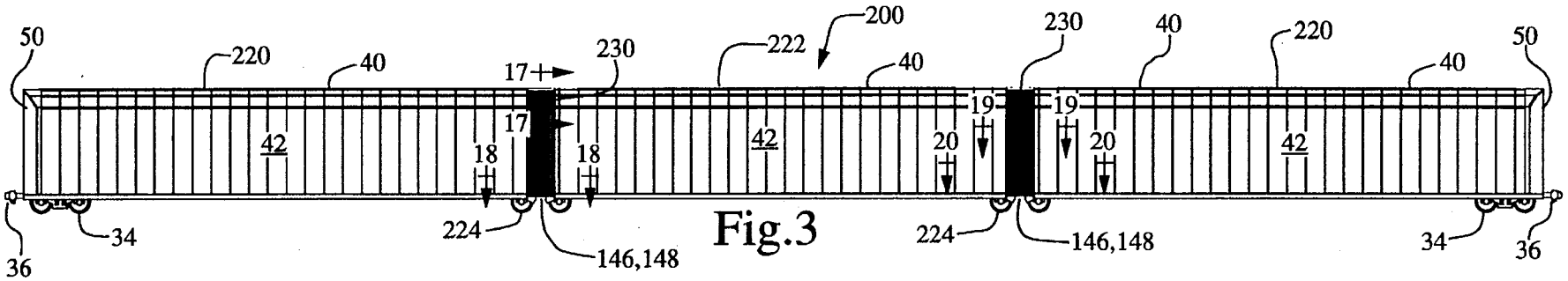
FIG. 3 is a side elevation view of an articulated automobile transport car that is also constructed in accordance with the invention.
Figure 4:
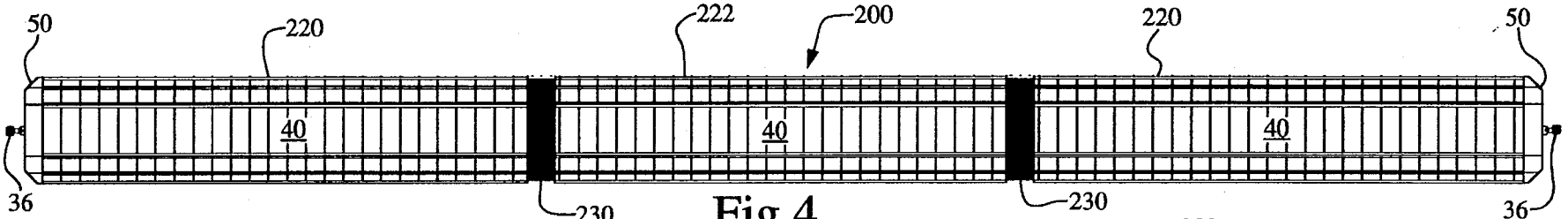
FIG. 4 is a top view of the car of FIG. 3.
Figure 5:
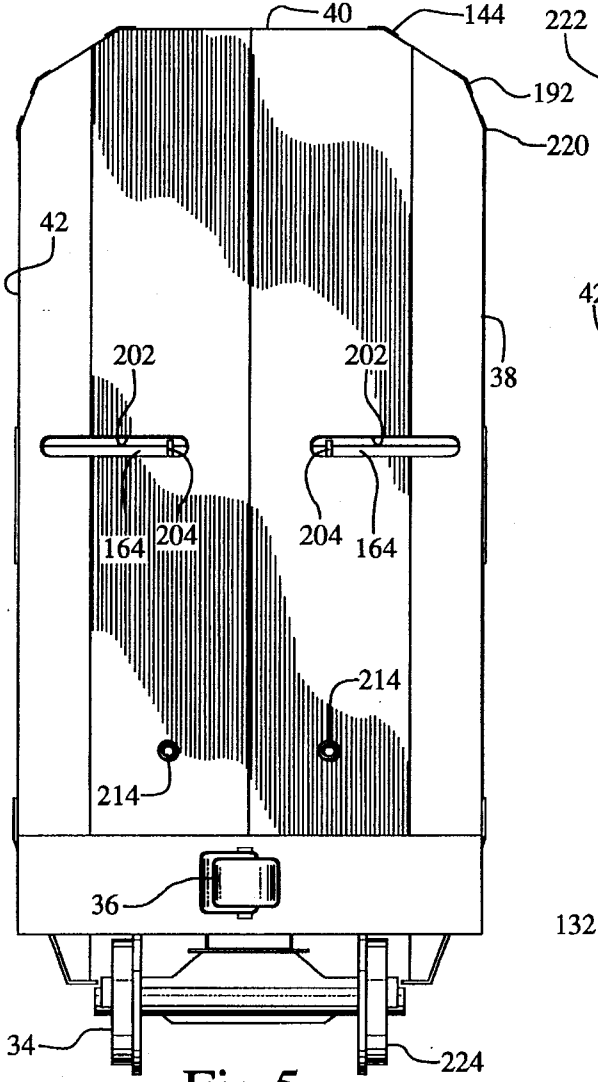
FIG. 5 is an end view of an end of a car with the doors closed.
Figure 16:
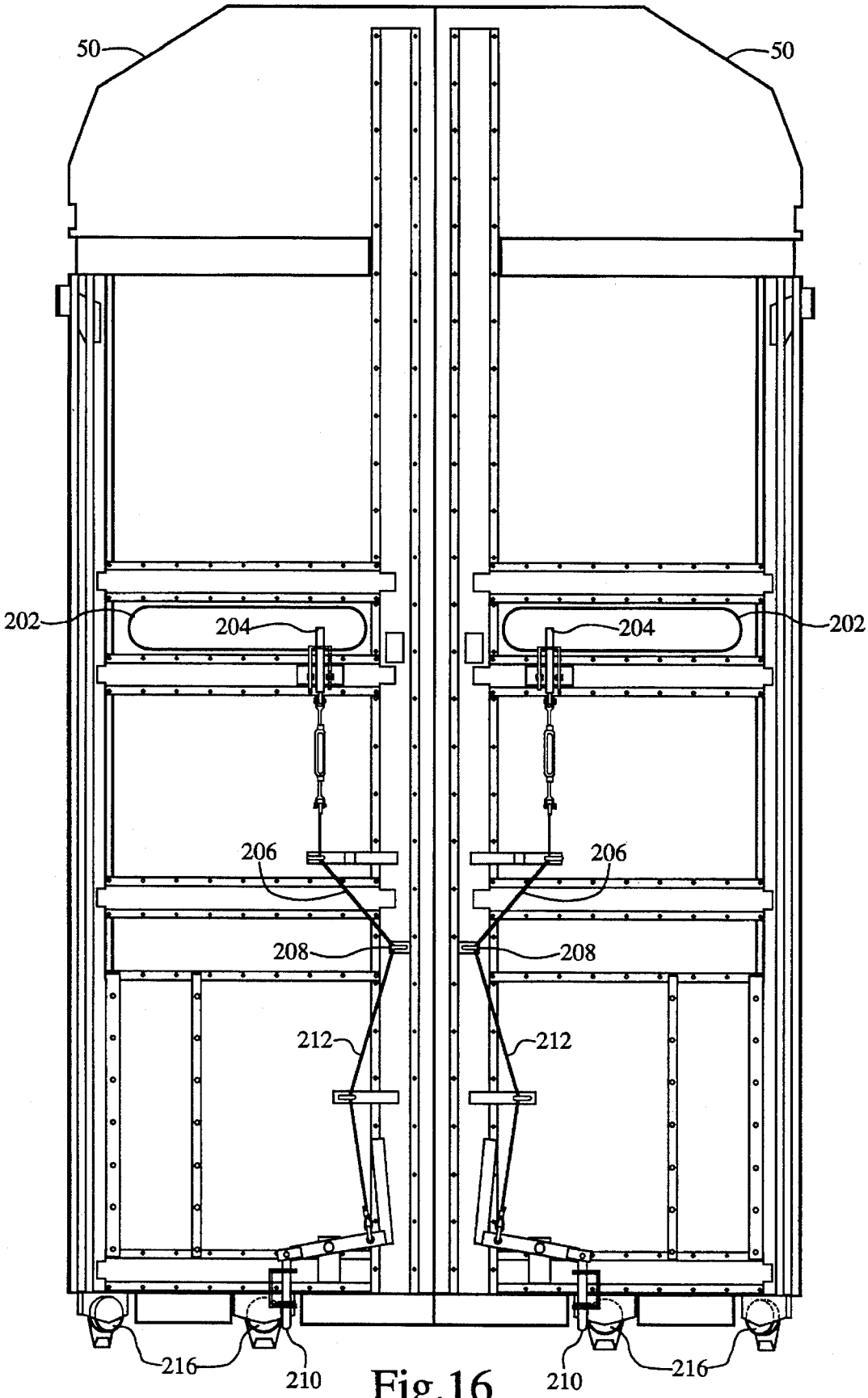
FIG. 16 is an elevational view of one end door as viewed from the inside of the car.

FIGS. 5 and 16 illustrate the structure of the end doors 50 that are located on the ends of the car 30 and on one end of each of the end units of the articulated car 200 which is illustrated in FIGS. 3 and 4 and will be described in more detail hereinafter. As shown most clearly in FIG. 5, the doors 50 extend from the bottom floor to the roof 40 of the car and are split at the centerline of the car. Slots 202 are formed in the doors 50 through which the upper deck 164 can be seen. Also, locking pins 204 can be seen through the slots 202.

In FIG. 16, the locking pins 204 are shown in the slots 202. The locking pins 204 are connected by an operating linkage 206 with an operating member 208. Similarly, locking pins 210 are connected by operating linkage 212 with the operating member 208. Holes 214 (FIG. 5) extend through the door 50 for access to the latch operating mechanism 208. To preserve the security Of the car, a special tool (not shown) must be inserted through the holes 214 to release the latch pins 204 and 210.

The doors 50 are each mounted on rollers 216 which are mounted on tracks (not shown) located on the end structure 134 so that the doors 50 can be moved to an open position (not shown) wherein they occupy a space alongside the exterior walls of the car 30. When open, the doors 50 provide access to the interior of the car and when closed, prevent entry thereinto. Since a special tool is required to open the doors, it is difficult for vandals to gain access to the interior of the cars. Also, and as clearly shown in FIGS. 1, 3 and 5, the doors 50 improve the aerodynamics of the car as well as protecting automobiles located therein from the elements.

With noted exceptions, almost everything described to this point is interchangeable between the car 30 and the articulated car 200. FIGS. 3 and 4 clearly show the articulated car 200 which consists of end cars 220 and at least one intermediate car 222. The end cars 220 and intermediate car 222 are interconnected by pivotal couplers 146 and 148 previously described in connection with FIG. 7. It will be noted that the outermost ends of the end cars 220 are provided with standard railway trucks 34 as described in connection with FIG. 1. Adjacent, connected ends of the end cars 220 and intermediate car 222 are supported for movement on railway tracks by trucks 224 which are shared by both cars. The construction and arrangement of the trucks 224 are well known in the industry.

In an effort to provide weather protection for the automobiles carried within the articulated car 200, the units thereof are interconnected by bellows assemblies 230. As may be seen more clearly in FIGS. 3 and 4, the bellows assemblies 230 extend around the perimeter of the cars and terminate on each side adjacent to the trucks 224.

Figure 18:
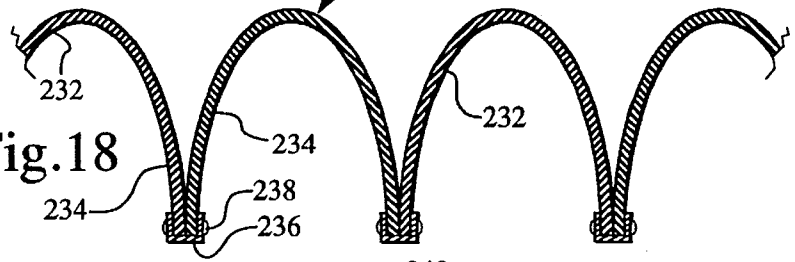
FIG. 18 is an enlarged, fragmentary cross-sectional view of the bellows taken along the line 18—18 of FIG. 3.
Figure 22:
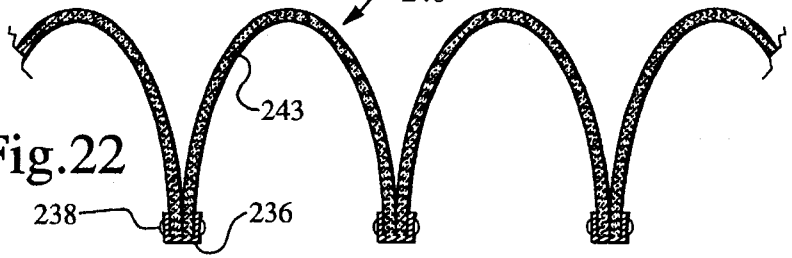
FIG. 22 is a view similar to FIG. 18, but illustrating a modification of the bellows.
Figure 17:
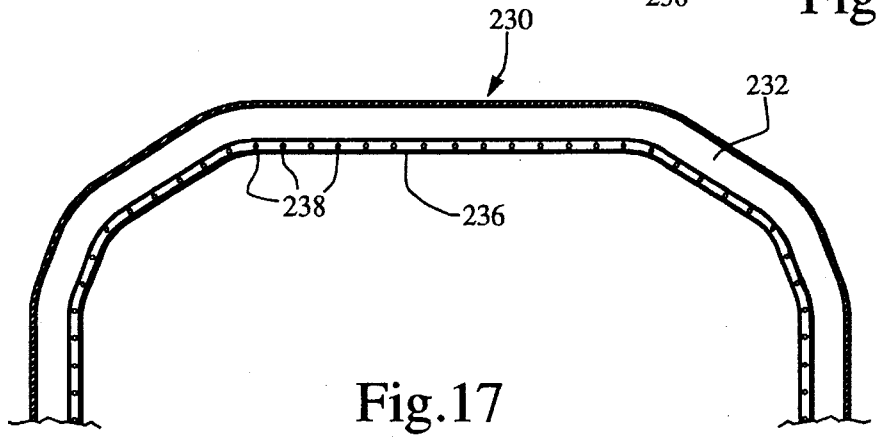
FIG. 17 is an enlarged, fragmentary cross-sectional view of a bellows connecting the units of the car of FIG. 3 taken along the line 17—17 of FIG. 3.

The bellows assemblies 230 are shown in more detail on the enlarged, fragmentary views of FIGS. 18 and 22. As shown therein, the bellows assemblies 230 consists of a plurality of U-shaped members 232 constructed from a flexible material such as neoprene or rubber. The legs 234 of the U-shaped members 232 are connected by a channel 236 that is preferably constructed from aluminum. As shown in FIG. 17, the channel members 236 are connected to the legs 234 by a plurality of rivets 238 or other suitable fasteners. Sufficient U-shaped members 232 are assembled to span the distance between adjacent or connected units of the articulated car 200. At each end of the assembly of U-shaped members 232, the bellows assemblies 230 are suitably connected to the ends of the adjacent cars. Thus, there is formed between the adjacent units of the articulated car 200 a weather-proof and vandal-proof covering that permits relative movement between the units while maintaining the integrity of the connection therebetween.

FIG. 22 illustrates a slight modification of the bellows assembly which is designated by the reference character 240. In the bellows assembly 240, each of the U-shaped members 242 is impregnated with a layer or layers of a wire mesh or woven wire 243 so that the U-Shaped members 242 are not subject to being cut with a knife or other sharp object. The modification 240 provides more integrity against possible vandalism due to the improvement provided by the wire mesh.

Figure 20:
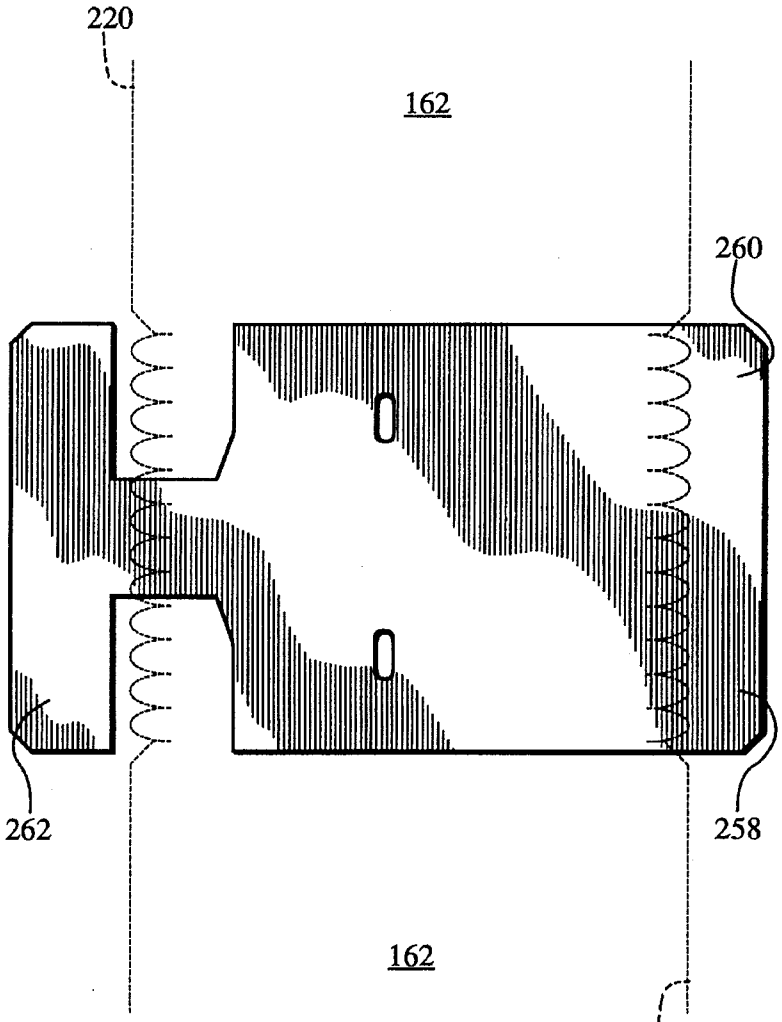
FIG. 20 is a view similar to FIG. 19 showing a lower deck bridge.

One further distinction between the articulated car 200 and the car 30 is that, in order to load the automobiles into the car through the end doors 50, some means must be provided for bridging the space between the interconnected and adjacent units of the articulated car. Accordingly, FIGS. 19 and 20 illustrate bridges that are permanently mounted in the units for this purpose.

Figure 19:
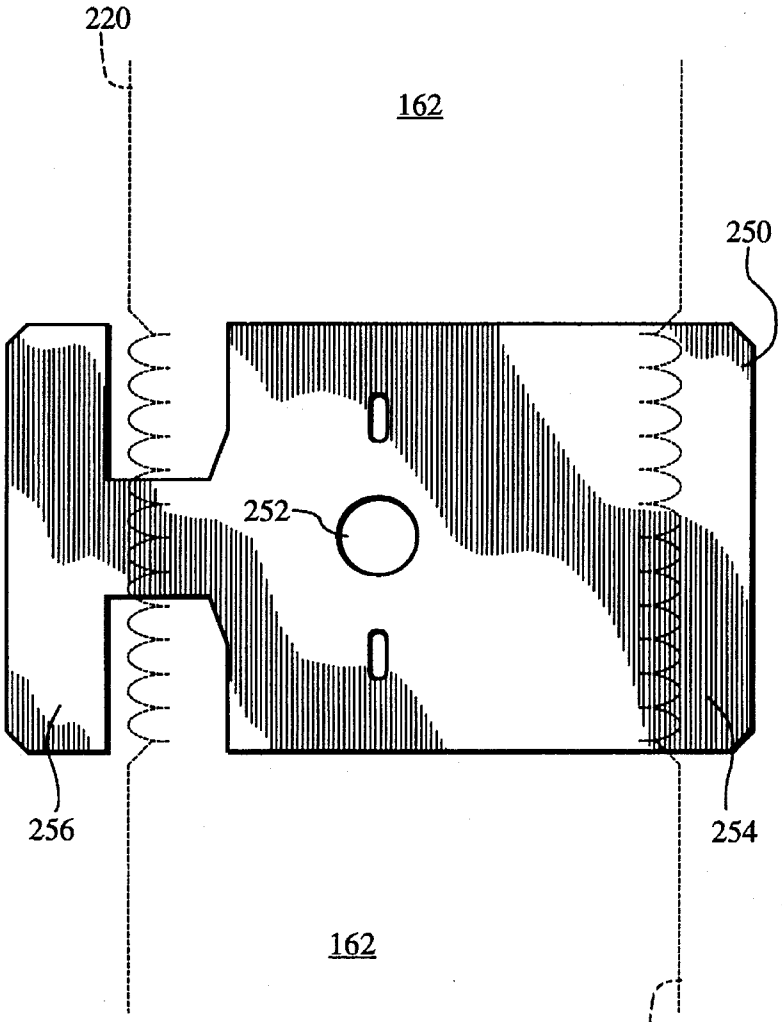
FIG. 19 is a cross-sectional view illustrating a bridge between the upper deck of adjacent unit cars taken generally along the line 19—19 of FIG. 3.

FIG. 19 illustrates a bridge 250 that is located on the lower deck or floor 162. The bridge 250 is provided with a covered opening 252 which is sized and arranged to receive the pivotal connection between the units of the articulated car 200. Thus, the bridge 250 has one end 254 resting, for example, in the car 222 and a second end 256 resting in the car 220 so that the bridge 250 spans the space between the two cars permitting automobiles to be driven thereover.

Similarly, bridge 258 is positioned between the upper floors or decks 164 of adjacent or connected units. It is not necessary to provide the capped opening 252 therein since the bridge 258 is located substantially above the coupler 148. The bridge 258 is provided with ends 260 and 262 which would, for example, rest on the upper decks 164 of connected and adjacent cars 222 and 220, respectively. Accordingly, automobiles loaded into the upper deck or decks of the articulated car 220 can move across the bridges between adjacent cars during unloading and loading.

Figure 21:
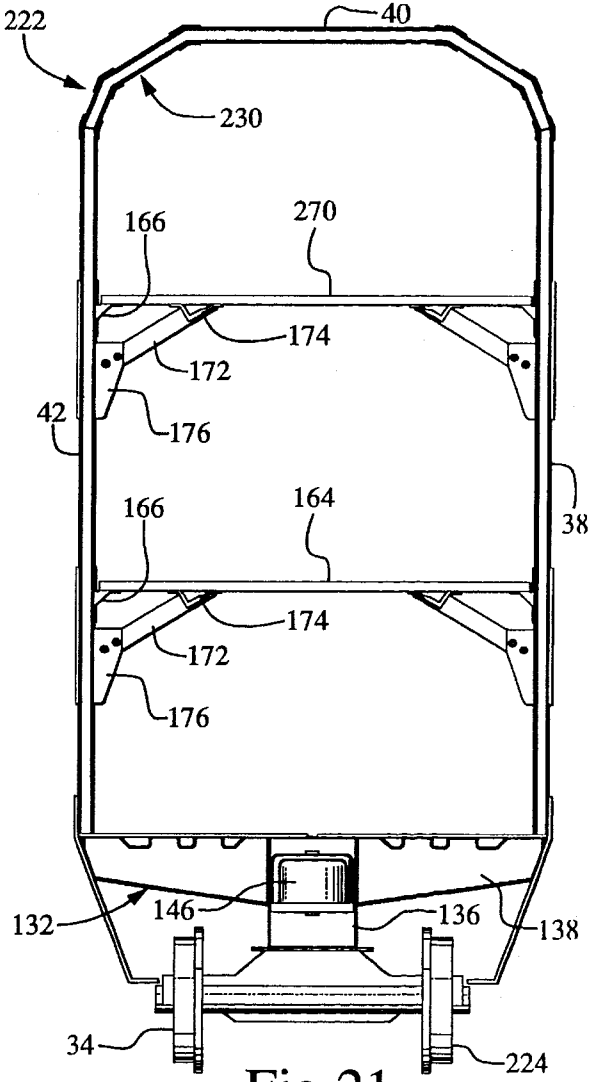
FIG. 21 is a view similar to FIG. 6 but illustrating a modification to the auto transport car to include an additional deck.

A modification can be made to either the car 30 or to the car 200 as illustrated in FIG. 21. The modification consists of a third deck 270 that is located between the deck 164 and the roof 40. The deck 270 is supported by extrusions 166 and 174 as previously described in connection with the support for the deck 164. Braces 172 are supported by gussets 176 as required as was true of the support for the floor 164.

The car 30 or 200 with two decks can adequately receive virtually any type of automobile or light truck. If the third deck is added as illustrated in FIG. 21, a larger number of appropriately sized automobiles may be carried by car 30 or 200.

In use, the car 30 is positioned adjacent to appropriate loading ramps with the doors 50 open. Additional cars 30 may be positioned end-to-end with the car 30 and all loaded from one end with appropriate loading bridges provided between the cars. After loading, the loading bridges must be removed and the doors 50 closed thus securing the vehicles within each car.

In the case of the articulated cars 200, substantially more vehicles can be loaded thereinto without the necessity of providing additional loading bridges. In the event that a large number of vehicles are to be loaded, additional articulated cars can also be placed end to end with loading bridges provided between the adjacent end units. After vehicles have been loaded, it is only necessary to remove the loading bridges between adjacent articulated cars 200, close the end doors 50 on the end units, to secure all vehicles within the articulated cars.

From the foregoing, it will be appreciated that the improved railway cars described herein in detail are capable of providing essentially weather-proof and vandal-proof transportation for automobiles or other goods that may be loaded thereinto. While the cars are intended for the purpose of loading automobiles, it should be obvious that other articles could be transported thereby if desired. The construction of the various components such as the decks from aluminum, drainage through the extrusions 166 and the corrugated deck structure, construction of the roof and walls from composite material, bellows between units, and end doors enclosing the cars provide freedom from damage to the vehicles as a result of weather, rust, and vandalism. Additionally, the cars should be easy to maintain as compared to the old steel cars and thus operate more economically.

It will be understood that the detailed disclosures made hereinbefore and presented by way of example and the many changes and modifications can be made thereto without departing from the spirit and scope of the invention.

What is claimed is:

1. An improved articulated railway car having at least a first end unit and a second end unit interconnected by pivotal couplers, each unit having a front, rear and two sides forming a hollow interior for transporting vehicles comprising:

a pair of spaced trucks for movably supporting each unit on railway tracks;

a center sill having a first end supported by one of said trucks and a second end supported by the other of said trucks;

at least one of said pair of trucks shared by another unit;

a plurality of cross-bearers spaced along and disposed generally perpendicular to and connected to said center sill, said cross-bearers having free ends remote from said center sill;

a plurality of side wall support posts extending generally vertically from and mounted respectively on said cross-bearers;

said side walls connected to said posts, each of said side walls having a lower edge adjacent to said cross-bearers, an upper edge, and front and rear edges adjacent the front and rear of each unit, respectively;

a roof extending from the front to the rear of each unit and connected to said upper edges of said side walls;

a first end closure located at one end of said first end unit and a second end closure located at one end of said second end unit and each end closure connected to said front edges of said side walls of said respective end units;

a floor mounted on said center sill and cross-bearers of each unit with said floor extending between said end closures and between said side walls;

an expandable and collapsible bellows substantially spanning and enclosing adjacent ends of said units which do not have an end closure;

said bellows connected respectively to said adjacent ends of each unit and extending around the perimeter of each unit with said bellows terminating on each side of said respective unit adjacent to said trucks;

said bellows further comprising a plurality of flexible members having a configuration to match said adjacent ends of each unit;

each of said flexible members including flexible reinforcing metal wire; and a bridge member extending between the units and including a central opening for receiving a pivotal coupler.

2. The car of claim 1 wherein said bellows further comprises:

each of said flexible members having a generally U-shaped configuration;

a plurality of elongated channels sized to receive free ends of said flexible members; and means for connecting said channel members to said free ends of said flexible members.

3. The articulated railway car of claim 1 further comprising:

a second floor located between said first-mentioned floor and said roof and coextensive with said first-mentioned floor of each unit; and supports connected to said side posts for positioning said second floor in each unit.

4. The articulated railway car of claim 3 further comprising:

a third floor located between said first-mentioned floor and said roof and coextensive with said first-mentioned floor of each unit; and a second support connected to said side posts for positioning said third floor in each unit.

5. The articulated railway car of claim 4 wherein said end closure includes an end door arranged to be opened and closed permitting and preventing access to said first-mentioned floor, said second floor, and said third floor of said end units.

6. An improved articulated railway car for transporting automotive vehicles including a plurality of units comprising:

a frame and a floor for each unit;

a pair of end units, each of said end units having first and second ends, a plurality of vertically extending, spaced side wall support posts on said frame between said first and second ends, said end units supported for movement on railway tracks by trucks located adjacent to said first and second ends;

at least one intermediate unit pivotally connected with the first ends of said end units, said intermediate unit being supported for movement on railway tracks by sharing the trucks located at the first ends of said end units and having a plurality of vertically extending, spaced side wall support posts on said frame means;

each end unit and each intermediate unit including side walls and a roof;

said roof further comprising connecting means joining the roof means to said side walls;

a second floor located between said first-mentioned floor and said roof and coextensive with said first-mentioned floor;

an expandable and collapsible bellows substantially spanning and enclosing adjacent ends of said units, said bellows connected respectively to adjacent ends of each unit;

a plurality of flexible, generally U-shaped members having a configuration to match the ends of each unit;

a plurality of elongated channels sized to receive free ends of said U-shaped members;

means for connecting said channel members to said U-shaped members;

each said U-shaped member includes flexible reinforcing metal wire;

said wall sections, said bellows, said first floor, and said roof cooperating to provide a vandal-proof covering that permits movement between said units;

a center sill extending between said respective trucks for each unit;

said first-mentioned floor mounted on said center sill;

a plurality of cross-bearers connected to said center sill and extending between said side walls;

a relatively uniform, open interior extending from one of said end units through said intermediate unit and said other end unit along with said bellows associated with each of said units; and a bridge member extending between the units and including a central opening for receiving a pivotal coupler.

7. The car of claim 6 further comprising:

a third floor located between said second floor and said roof and coextensive with said first-mentioned floor.

8. The car of claim 6 wherein said end units further comprise an end closure including an end door arranged to be opened and closed permitting and preventing access to the interior of said car.

9. The car of claim 8 wherein said end closure includes connections to the front and rear edges of said walls and to said roof.

10. The car of claim 9 wherein said end closure also includes a door arranged to be opened and closed permitting and preventing access to the interior of said car.

11. The articulated railway car of claim 6 further comprising:

said bridge member being a floor bridge extending between and spanning the space between the first-mentioned floor of adjacent units; and a second floor bridge extending between and spanning the space between said second floor of adjacent units.

12. The articulated railway car of claim 7 further including:

said bridge member being a floor bridge extending between and spanning the space between the first-mentioned floor of connected units;

a second floor bridge extending between and spanning the space between the second floor of connected units; and a third floor bridge extending between and spanning the space between the third floor of connected units.

13. An improved articulated railway car having at least a first end unit and a second end unit interconnected with each other by pivotal couplers, each unit having a front, rear, and two sides forming a hollow interior for transporting automotive vehicles comprising:

a pair of tracks spaced longitudinal from each other for movably supporting each unit on railway tracks;

one of said pair of trucks shared by another unit;

each unit having a center sill with a first end supported by one of said trucks and a second end supported by said shared truck;

a plurality of cross-bearers spaced along and disposed generally perpendicular to and connected respectively to each of said center sills, said cross-bearers having free ends remote from said respective center sills;

a plurality of side wall support posts extending generally vertically from and mounted respectively on said cross-bearers;

said side walls connected to said posts, each of said side walls having a lower edge adjacent to said cross-beams, an upper edge, and front and rear edges adjacent the front and rear of each unit, respectively;

a roof extending from the front to the rear of each unit and connected to the upper edges of said side walls;

an end closure located at one end of said first end unit and at one end of said second end unit and connected to the front and rear edges of said side walls;

a plurality of expandable and collapsible bellows substantially spanning and enclosing adjacent ends of said units, said bellows connected respectively to adjacent ends of each unit at said shared truck;

said bellows further comprising a plurality of flexible, generally U-shaped members having a configuration to match said adjacent ends of each unit;

means for connecting free ends of each of said U-shaped members with free ends of adjacent U-shaped members;

each of said U-shaped member including flexible reinforcing metal wire;

a relatively uniform, open interior extending from one of said end units through said bellows and said other end unit; and a bridge member extending between the units and including a central opening for receiving a pivotal coupler.

14. The car of claim 13 wherein said roof comprises connecting means joining the roof means to said side walls.

15. The car of claim 13 further comprising a floor mounted on said center sill and cross-bearers of each unit and extending between said end closures and between said side walls.

16. The car of claim 15 further comprising:

a second floor located between said first-mentioned floor and said roof and coextensive with said first-mentioned floor of each unit; and supports connected to said side posts for positioning said second floor in each unit.

17. The car of claim 16 further comprising:

a third floor located between said first-mentioned floor and said roof and coextensive with said first-mentioned floor of each unit; and a second support connected to said side posts for positioning said third floor in each unit.

18. The car of claim 17 wherein said end closure includes an end door arranged to be opened and closed permitting and preventing access to said first-mentioned floor, said second floor, and said third floor of said end units.

19. An improved articulated railway car having at least a first end unit and a second end unit interconnected by pivotal couplers, each unit having a front, rear and two sides forming a hollow interior for transporting vehicles comprising:

a pair of spaced trucks for movably supporting each unit on railway tracks;

each unit having a center sill with a first end supported by one of said trucks and a second end supported by the other of said trucks;

at least one of said pair of trucks shared by another unit;

a plurality of cross-bearers spaced along and disposed generally perpendicular to and connected with each of said center sills, each of said cross-bearers having one end remote from said respective center sill;

each of said side walls having a lower edge adjacent to said cross-bearers, an upper edge, and front and rear edges adjacent to said front and rear of each unit, respectively;

a roof extending from said front to said rear of each unit and connected to said upper edges of said respective side walls;

a first end closure connected at one end of said first end unit and a second end closure located at one end of said second end unit with each end closure connected to said front edges of said side walls of said respective end units;

a first floor mounted on said center sill and said cross-bearers of each unit with said first floor extending from said respective end closure between said side walls;

a second floor located between said first floor and said roof with said second floor extending coextensive with said first floor of each respective unit;

an expandable and collapsible bellows substantially spanning and enclosing adjacent ends of said units with one of said pair of trucks disposed between said adjacent ends of said units;

said bellows connected to said adjacent ends of said respective units and extending from the perimeter of each of said units with said bellows terminating on each side of said respective units adjacent to said trucks;

said bellows further comprising a plurality of flexible members having a configuration to match said adjacent ends of said units;

each of said flexible members including flexible reinforcing metal wire;

a relatively uniform, open interior extending from one of said end units through said bellows and said other end unit; and a bridge member extending between the units and including a central opening for receiving a pivotal coupler.

* * * * *